United States Patent [19]

Young

[11] 4,103,838

[45] Aug. 1, 1978

[54] ADJUSTABLE TOILET PAPER HOLDER

[76] Inventor: Ernest V. Young, 3 Park View La., Bradford, Mass. 01830

[21] Appl. No.: 766,086

[22] Filed: Feb. 7, 1977

[51] Int. Cl.[2] ..... A47K 10/24
[52] U.S. Cl. ..... 242/55.2
[58] Field of Search ..... 242/55.2, 55.53, 55.3, 242/55.54

[56] References Cited

U.S. PATENT DOCUMENTS

| | | | |
|---|---|---|---|
| 2,709,608 | 4/1957 | Sieven | 242/55.3 |
| 3,844,500 | 10/1974 | Krause | 242/55.54 |
| 3,848,822 | 11/1974 | Boone | 242/55.2 |

*Primary Examiner*—George F. Mautz

[57] ABSTRACT

This device consists primarily of a cylinder having set screw means for adjusting the elevation of a roll of paper, and it also includes set screw means for moving the paper inwards and outwards from the mounting surface.

4 Claims, 3 Drawing Figures

ADJUSTABLE TOILET PAPER HOLDER

This invention relates to roll paper holders, and more particularly, to an adjustable toilet paper holder.

A principal object of the invention is to provide an adjustable toilet paper holder, which will accommodate any size roll of toilet paper.

Another object of this invention is to provide a holder, of the type described, which will employ set screw means for raising and lowering the roll of paper.

A further object of this invention is to provide a holder, of the type described, which will be quickly and easily removed from the support bracket.

Other objects of the invention are to provide an adjustable toilet paper holder, which is simple in design, inexpensive to manufacture, rugged in construction, easy to use and efficient in operation.

These, and other objects, will be readily evident upon a study of the following specification, and the accompaning drawing, wherein.

Figure 1:
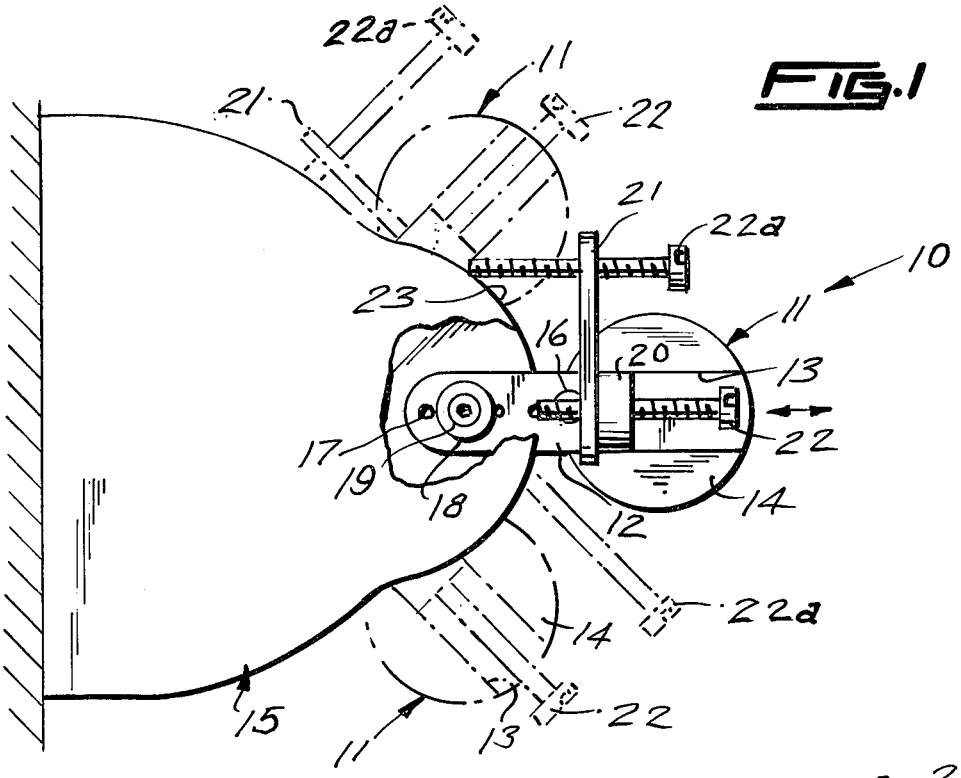
FIG. 1 is a side view of the present invention, showing various positions of the device in phantom lines.
Figure 2:
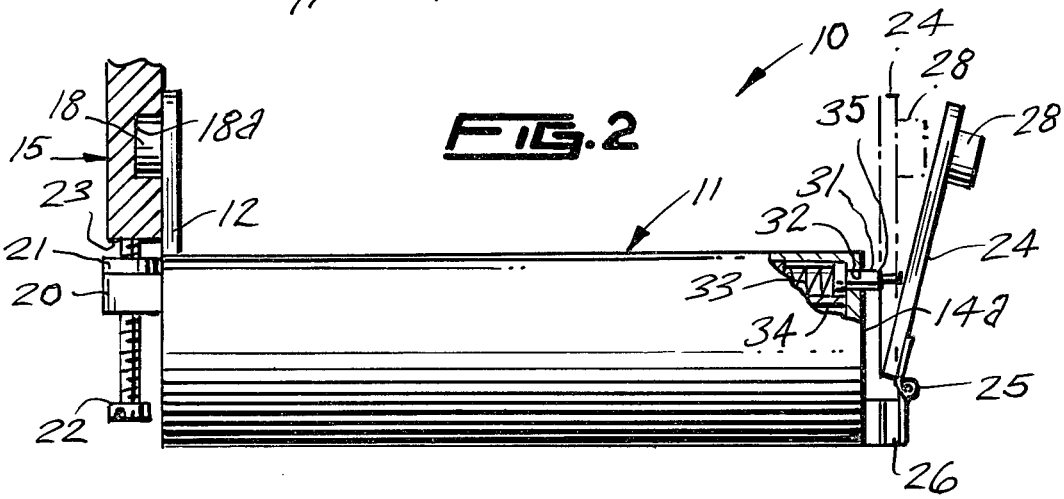
FIG. 2 is a fragmentary top plan view of FIG. 1.
Figure 3:
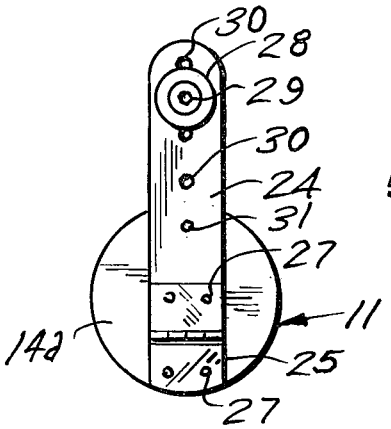
FIG. 3 is a right end view of FIG. 2.

According to this invention, a toilet paper holder 10 is shown to include a cylinder 11, which will removably receive a roll of paper, (not shown), for the sake of clarity. An arm 12 is secured stationary in transverse slot 13 of end wall 14 of cylinder 11, by means of screw fastener 16, which is received within one of the plurality of spaced apart openings 17 of arm 12. A cylindrical projection 18 is secured to arm 12 by screw fastener 19, which may be received in any of the openings 17, depending upon the size of the roll of paper that will be received on cylinder 11.

The aforementioned provides adjustment means of the cylinder 11, away from or towards the bracket 15.

The projection 18 is removably received within opening 18*a* of the mounting bracket 15, which supports holder 10. A projection 20 of arm 21, is fixedly secured to arm 12 in a suitable manner, and the extending end threadingly receives a set screw 22, which encroaches against the outer periphery 23 of mounting bracket 15.

Set screw 22 enables the adjustment of cylinder 11, towards and away from, bracket 15, so as to enable paper rolls of various diameters to be received in bracket 15, and it further serves as a means rendering cylinder 11 stationary at any elevation, in conjunction with the upper set screw 22*a*. Arm 21 is fixedly secured to projection 20 in a suitable manner, and threadingly receives the set screw 22*a*. The end of set screw 22*a* encroaches on the outer periphery 23 of bracket 15.

It shall be noted, that bracket 15 in FIG. 1, is shown partly broken away, so as to illustrate the mounting of holder 10 therein.

The opposite end wall 14*a*, of cylinder 11, is provided with a hinged arm 24, secured fixedly to hinge 25, which is fixedly secured to spacer 26. Spacer 26 is fixedly secured to end wall 14*a* by the fasteners 27. A cylindrical projection 28, similar to projection 18*a*, is removably secured to arm 24 by fastener 29, which is receivable in any of the plurality of openings 30, the arrangement being such, so as to adjust the position of cylinder 11 in conjunction with the arm 12, on the opposite end of holder 10. A pin 31 is removably received in an opening 30 of arm 24, and is slidably received within opening 32 of end wall 14*a*. Pin 31 is springingly urged outwards by means of spring 33, encased within sleeve 34, on the interior of cylinder 11. The shoulder 35 of pin 31 urges arm 24 outwards, so as to retain projection 28 within its opening 18*a* (not shown), of bracket 15. When it is desired to remove holder 10 from bracket 15, arm 24 is urged towards end wall 14*a*, thus releasing projection 28 from the opening 18*a* of bracket 15.

While various changes may be made in the detail construction, it is understood that such changes will be within the spirit and scope of the present invention, as is defined by the appended claims.

What I now claim is:

1. An adjustable toilet paper holder comprising an elongated cylinder for removably receiving a roll of paper thereon, a transverse slot on one end of said elongated cylinder, an opening within said transverse slot, a rigid arm slidably received within said transverse slot and having a plurality of openings therein, a first screw fastener received in one of said plurality of openings in said rigid arm and said opening within said transverse slot to secure said rigid arm to said elongated cylinder, a first cylindrical projection, a second screw fastener received in a second of said plurality of openings in said rigid arm to secure said first cylindrical projection to said rigid arm, a hinged arm on the other end of said elongated cylinder, a second cylindrical projection, and means attaching said second cylindrical projection to said hinged arm whereby the holder can be supported by said projections within opposed openings of a mounting bracket.

2. An adjustable toilet paper holder as in claim 1 wherein said rigid arm includes an integral, outwardly extending projection, a first set screw extending through said outwardly extending projection, a vertically extending projection, a vertically extending arm attached to said outwardly extending projection a second set screw extending through said vertically extending arm, whereby the position of the set screw can be adjusted to locate and secure the elongated cylinder relative to the mounting bracket to accommodate rolls of varying sizes.

3. An adjustable toilet paper holder as in claim 2 including hinge means attaching said hinged arm to said elongated cylinder, means biasing said hinged arm axially outwardly from said elongated cylinder, means for adjusting the position of said second cylindrical projection on said hinged arm, said hinged arm being movable to a horizontal position to enable a roll of paper to be placed on said elongated cylinder.

4. An adjustable toilet paper holder as in claim 3 wherein said biasing means comprises an axially extending opening in said elongated cylinder, a sleeve having a spring and pin therein, said sleeve being secured in said axially extemding opening and said pin being biased outwardly against said hinged arm to urge said hinged arm and second cylindrical projection thereon into supporting engagement with the mounting bracket.

* * * * *